US009597556B2

(12) United States Patent
Cerf

(10) Patent No.: US 9,597,556 B2
(45) Date of Patent: Mar. 21, 2017

(54) SYSTEM FOR TENSIONING A RACKET STRING AND STRINGING MACHINE COMPRISING SUCH A SYSTEM

(71) Applicant: BABOLAT VS, Lyons (FR)

(72) Inventor: Herve Cerf, Chasse sur Rhone (FR)

(73) Assignee: BABOLAT VS, Lyons (FR)

( * ) Notice: Subject to any disclaimer, the term of this patent is extended or adjusted under 35 U.S.C. 154(b) by 0 days.

(21) Appl. No.: 14/924,086

(22) Filed: Oct. 27, 2015

(65) Prior Publication Data

US 2016/0121176 A1 May 5, 2016

(30) Foreign Application Priority Data

Oct. 31, 2014 (FR) ..... 14 60515

(51) Int. Cl.
*A63B 51/14* (2006.01)

(52) U.S. Cl.
CPC ..... *A63B 51/14* (2013.01)

(58) Field of Classification Search
CPC ..... A63B 51/14; A63B 51/00
USPC ..... 473/557, 556; 1/1
See application file for complete search history.

(56) References Cited

U.S. PATENT DOCUMENTS 3,441,275 A 4/1969 Held
3,988,022 A * 10/1976 Halbrook ..... A63B 51/14 473/556
4,366,958 A * 1/1983 Bosworth ..... A63B 51/14 269/189
4,417,729 A * 11/1983 Morrone ..... A63B 51/14 473/556
4,620,705 A * 11/1986 Tsuchida ..... A63B 51/14 254/231
4,706,955 A 11/1987 Ngadi et al.
8,206,249 B1 * 6/2012 Wise ..... A63B 51/14 473/557
9,067,111 B2 * 6/2015 Zdrazila ..... A63B 51/14

OTHER PUBLICATIONS

French Search Report, dated Jun. 19, 2015, from corresponding French Application.

* cited by examiner

*Primary Examiner* — Aarti B Berdichevsky
*Assistant Examiner* — Christopher Glenn
(74) *Attorney, Agent, or Firm* — Young & Thompson

(57) ABSTRACT

This system (S) for tensioning a racket string (C) comprises a traction module (1) suitable for exerting a traction force (T) on a string (C) of a racket, including a grip (3) comprising two opposite jaws (32) suitable for gripping the string (C) between them when it is tensioned, and a traction head (5) on which the grip (3) is mounted, the jaws (32) being translatable simultaneously relative to the traction head (5) and arranged such that the translation of the jaws (32) causes them to tighten around the string (C), a rail (7) on which the traction head (5) of the traction module (1) is mounted translatably, and a traction motor able to translate the traction head (5) of the traction module (1) on the rail (7), via a driving system (13). The system comprises means (15) for transmitting movement between the driving system (13) of the traction head (5) and the jaws (32), this transmission means being able to initiate the translation of the jaws (32) relative to the traction head (5) in the direction gripping the string (C).

12 Claims, 8 Drawing Sheets

SYSTEM FOR TENSIONING A RACKET STRING AND STRINGING MACHINE COMPRISING SUCH A SYSTEM

FIELD OF THE INVENTION

The present invention relates to a system for tensioning racket strings and a stringing machine comprising such a tensioning system.

BACKGROUND OF THE INVENTION

In the field of racket sports, such as tennis, badminton, squash, or any other racket sports requiring the use of a screen of stretched strings, it is known to use stringing machines comprising a system for tensioning the strings. Such a system allows the stringer to place the strings and stretch them via a device for example using an electric motor.

It is known to maintain the strings in a grip comprising two jaws gripped against one another around the string. Once the string is maintained in the jaw, the tensioning system is activated and the grip undergoes a translational movement causing tensioning of the string.

The maintenance of the string in the grip is generally obtained by placing the string between the jaws, then folding it by a certain angle allowing the translation of the jaws along the longitudinal axis, which initiates gripping of the jaws against one another, owing to appropriate guideways.

Such an operation has the drawback of requiring action by the operator upon each tensioning, which involves lost time when the stringer in question has a significant workload. Furthermore, if the gesture by the operator causes excessive gripping of the string, that string may be destroyed, which increases the risk of breakage after the stringing.

SUMMARY OF THE INVENTION

The invention more particularly aims to resolve these drawbacks by proposing a new racket string tensioning system, the operation of which allows simpler and faster work by the operator, and optional gripping of the string in the grip.

To that end, the invention relates to a system for tensioning racket strings, comprising:

- a traction module suitable for exerting a traction force on a string of a racket, including a grip comprising two opposite jaws suitable for gripping the string between them when it is tensioned, and a traction head on which the grip is mounted, the jaws being translatable simultaneously relative to the traction head and arranged such that the translation of the jaws causes them to tighten around the string,
- a rail on which the traction head of the traction module is translatably mounted, and
- a traction motor able to translate the traction head of the traction module on the rail, via a driving system.

This tensioning system is characterized in that it comprises means for transmitting movement between the driving system of the traction head and the jaws, this transmission means being able to initiate the translation of the jaws relative to the traction head in the direction gripping the string.

Owing to the invention, the string is automatically gripped in the grip using the translational movement generated by the traction motor. Thus, the stringer no longer needs to keep the string in the grip or subject to an angle to tighten the jaws, which allows him to work more quickly while also reducing the risk of accidental damage to the string during gripping in the grip.

According to advantageous but optional aspects of the invention, such a tensioning system may incorporate one or more of the following features, considered in any technically allowable combination:

- The transmission means comprise a lever mounted pivoting on the traction head, part of the lever being connected to the jaws, one end of the lever being connected to the driving system such that the translation of the driving system drives the rotation of the lever relative to the traction head around an axis perpendicular to the translation direction of the traction head.
- The driving system comprises a belt or chain provided with a plate having an opening in which the end of the lever opposite the jaws is inserted.
- The opening comprises a surface able to cooperate by planar bearing with a surface of the lever to drive the traction head in translation along the rail during tensioning of the string.
- The rotation of the lever relative to the traction head is locked when the jaws are gripped around the string.
- The part of the lever secured to the jaws is simultaneously connected to each of the jaws by a rod provided with an elastic element configured so that the gripping of the jaws takes place before the translation of the traction head on the rail.
- The elastic element is a spiral spring.
- The rod is mounted sliding in slots of the jaws such that the rotation of the rod drives the translation of the jaws.
- Once the string has been stretched, the grip is able to be loosened under the action of the traction motor.

The invention also relates to a stringing machine comprising a tensioning system as described above.

BRIEF DESCRIPTION OF THE DRAWINGS

The invention will be better understood and other advantages thereof will appear more clearly in light of the following description of a system for tensioning racket strings according to its principle, provided as a non-limiting example in reference to the appended drawings, in which.

DETAILED DESCRIPTION OF THE INVENTION

Figure 1:
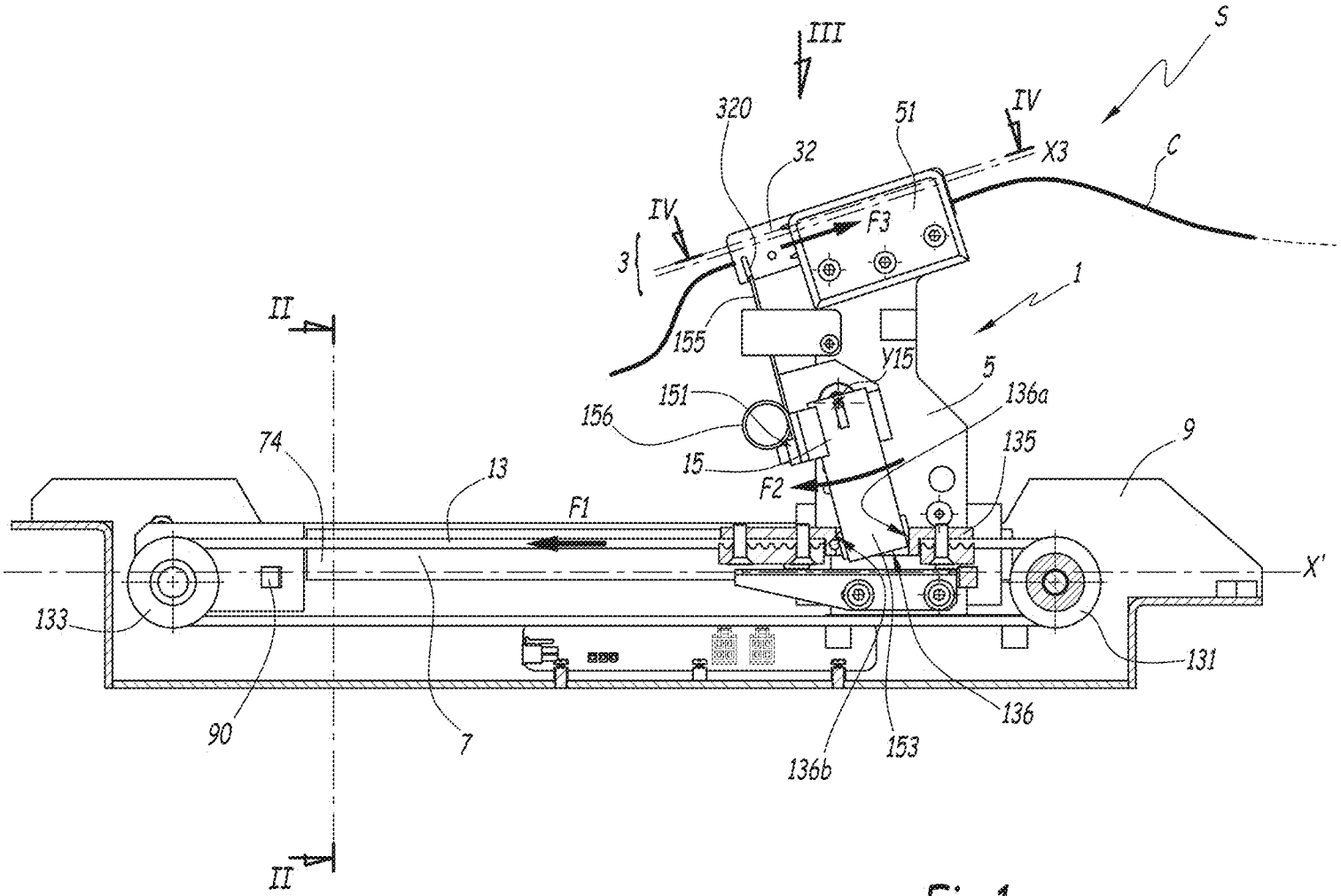
FIG. 1 is a sectional view of the tensioning system according to the invention, in a first configuration.

FIGS. 1 to 9 show a tensioning system S. This tensioning system S is designed to be part of a machine for stringing rackets, not shown, by exerting a traction force T on a string C of a racket, not shown, kept in place in the stringing machine.

The tensioning system S is suitable for stringing rackets for all types of racket sports, such as tennis, badminton, squash, etc.

The system S includes a traction module 1 suitable for exerting the traction force T.

The traction module comprises a grip 3 including two opposite jaws 31 and 32 suitable for gripping the string C during the traction. The grip 3 is mounted on the traction head 5, which in turn is translatably mounted on a rail 7, along a traction axis X-X'. The rail 7 is mounted on a frame 9 of the tensioning system S.

The system S also includes a traction motor 11, fixed on the frame 9, and able to translate, along the axis X-X', the traction head 5 along the rail 7, via a driving system, including a belt 13 stretched between a drive pulley 131, driven directly or indirectly by the traction motor 11, and a pulley 133 situated close to an opposite end of the frame 9 relative to the drive pulley 131. In an alternative that is not shown, the system S may comprise another type of drive system, for example a chain, rack, etc.

Figure 2:
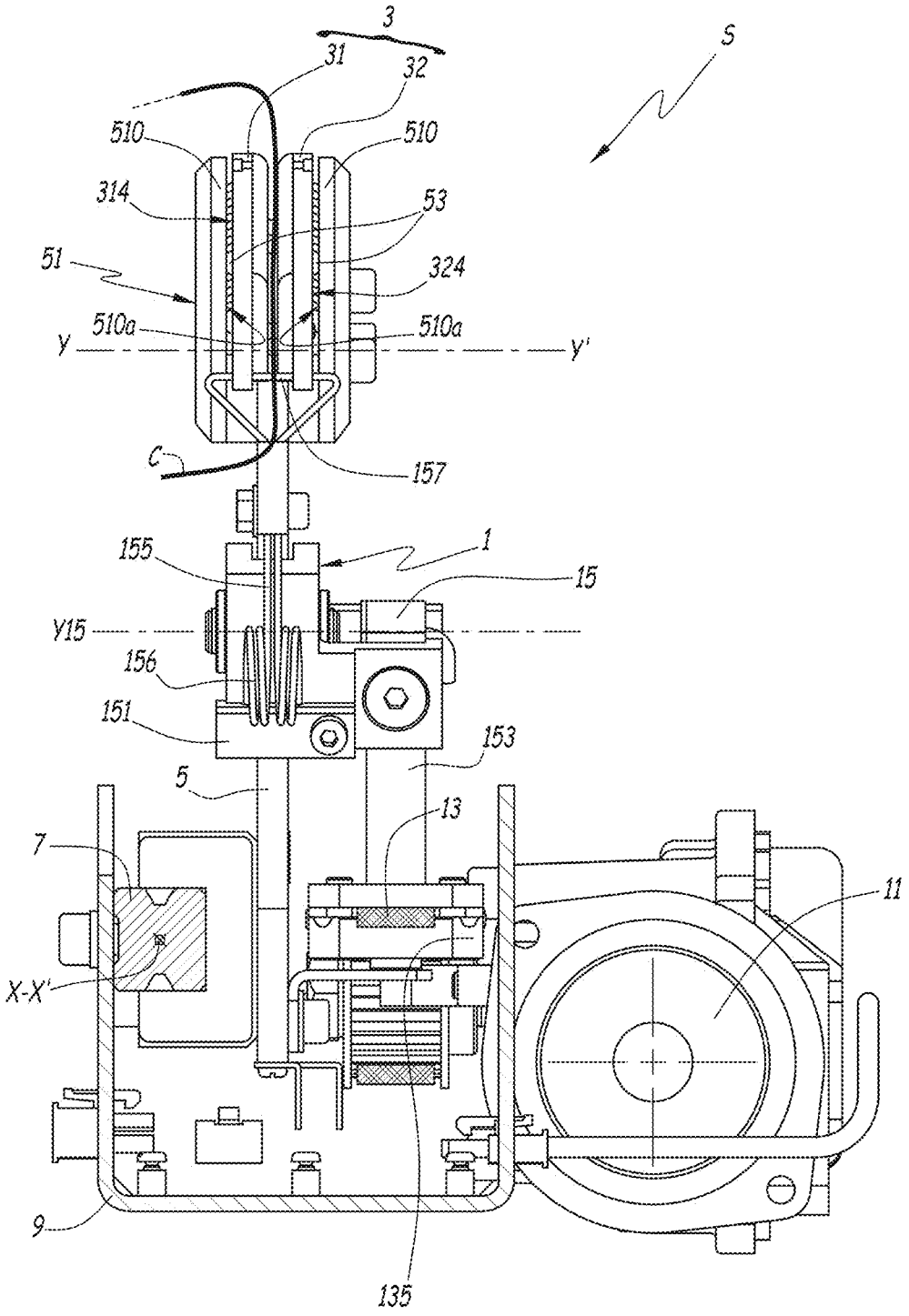
FIG. 2 is a sectional view along plane II-II of the tensioning system of FIG. 1.
Figure 3:
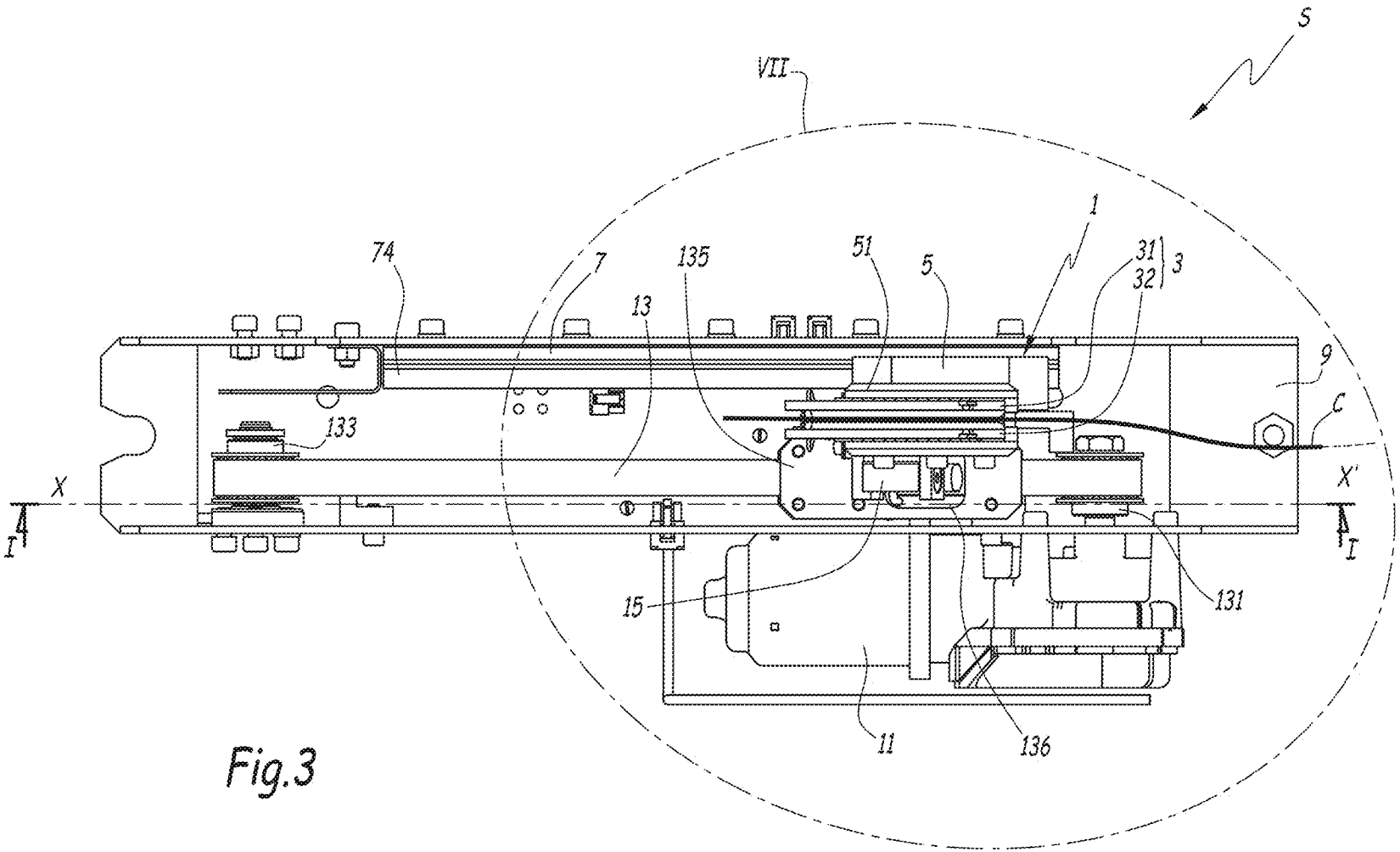
FIG. 3 is a top view along arrow III, of the tensioning system of FIGS. 1 and 2; in that figure, reference I-I indicates the cutting plane of FIG. 1.

FIGS. 1 to 4 show the initial configuration of the tensioning system S. In that configuration, the traction module 1 is positioned at a first end 72 of the rail 7, situated on the right in FIGS. 6 and 8, and the jaws 31 and 32 are separated from one another, as shown in FIG. 2.

Figure 4:
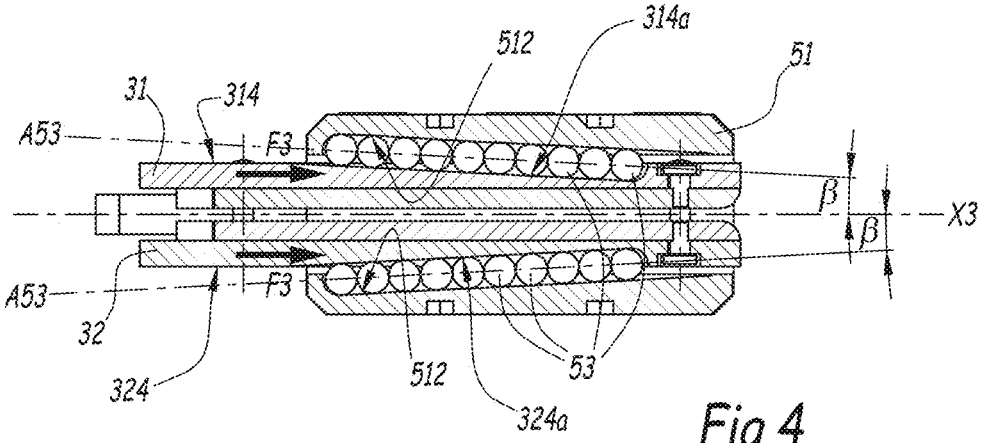
FIG. 4 is a cross-sectional view along plane IV-IV of a traction module of the tensioning system of FIGS. 1 and 3.
Figure 8:
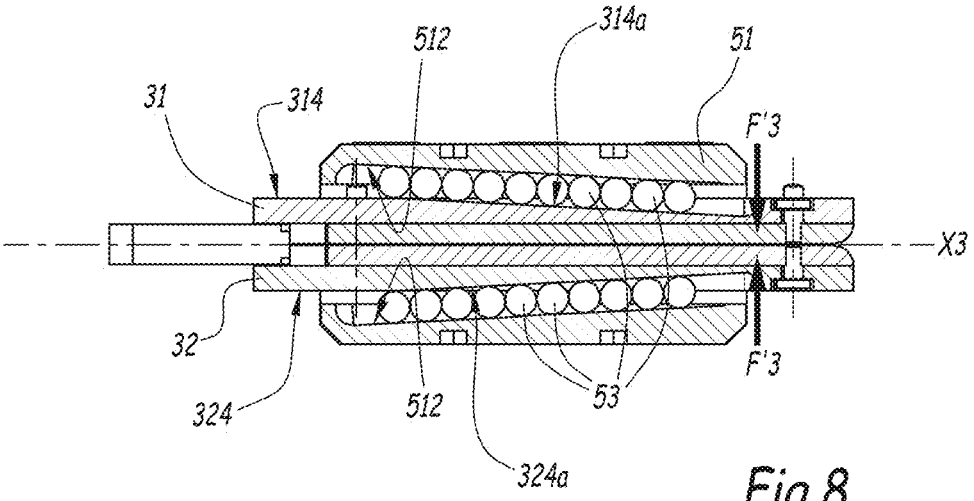
FIG. 8 is a cross-section similar to FIG. 4, in the configuration of FIGS. 5 to 7.
Figure 5:
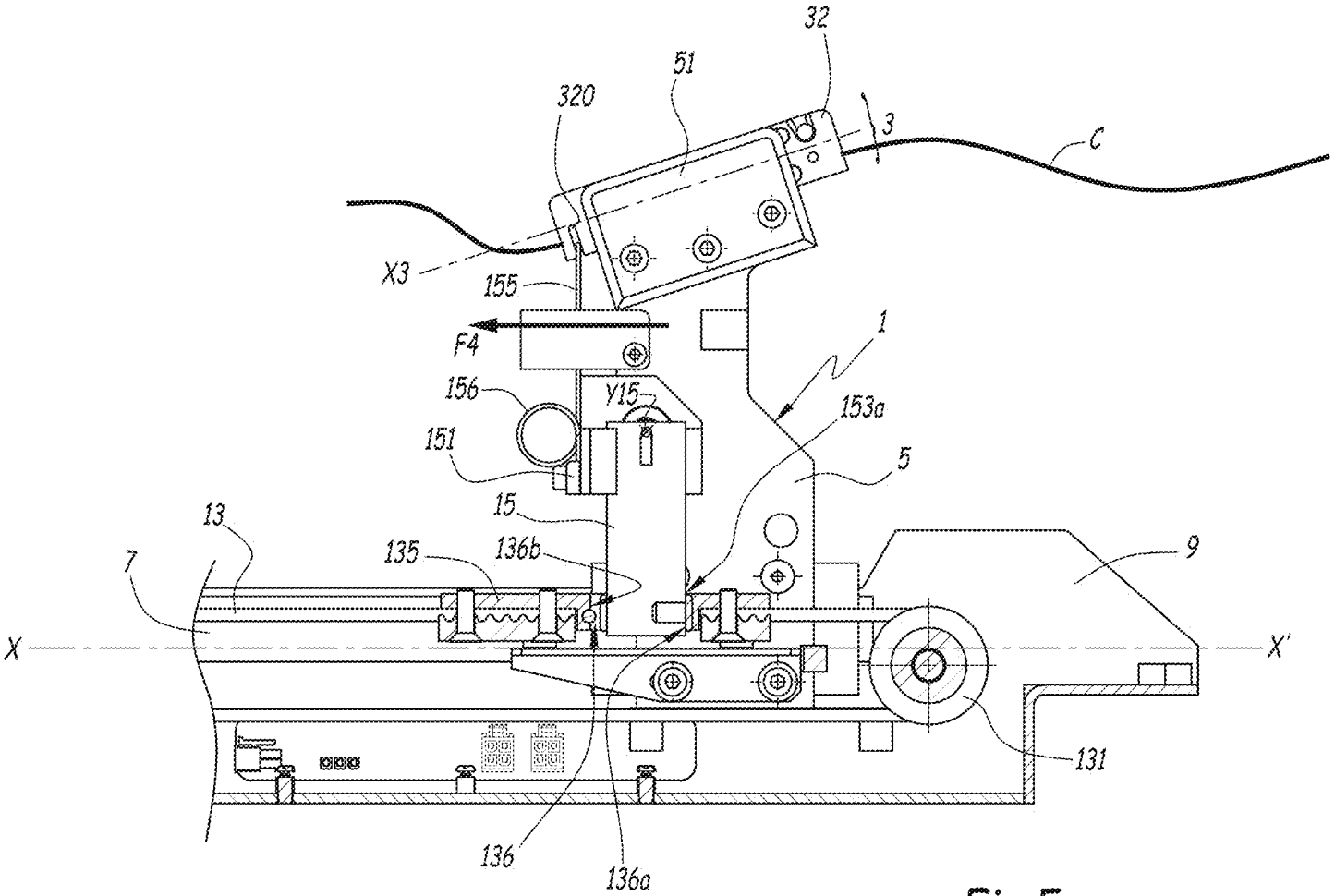
FIG. 5 is an enlarged cross-section similar to part of FIG. 1, of the tensioning system of FIGS. 1 to 3, in a second configuration.
Figure 6:
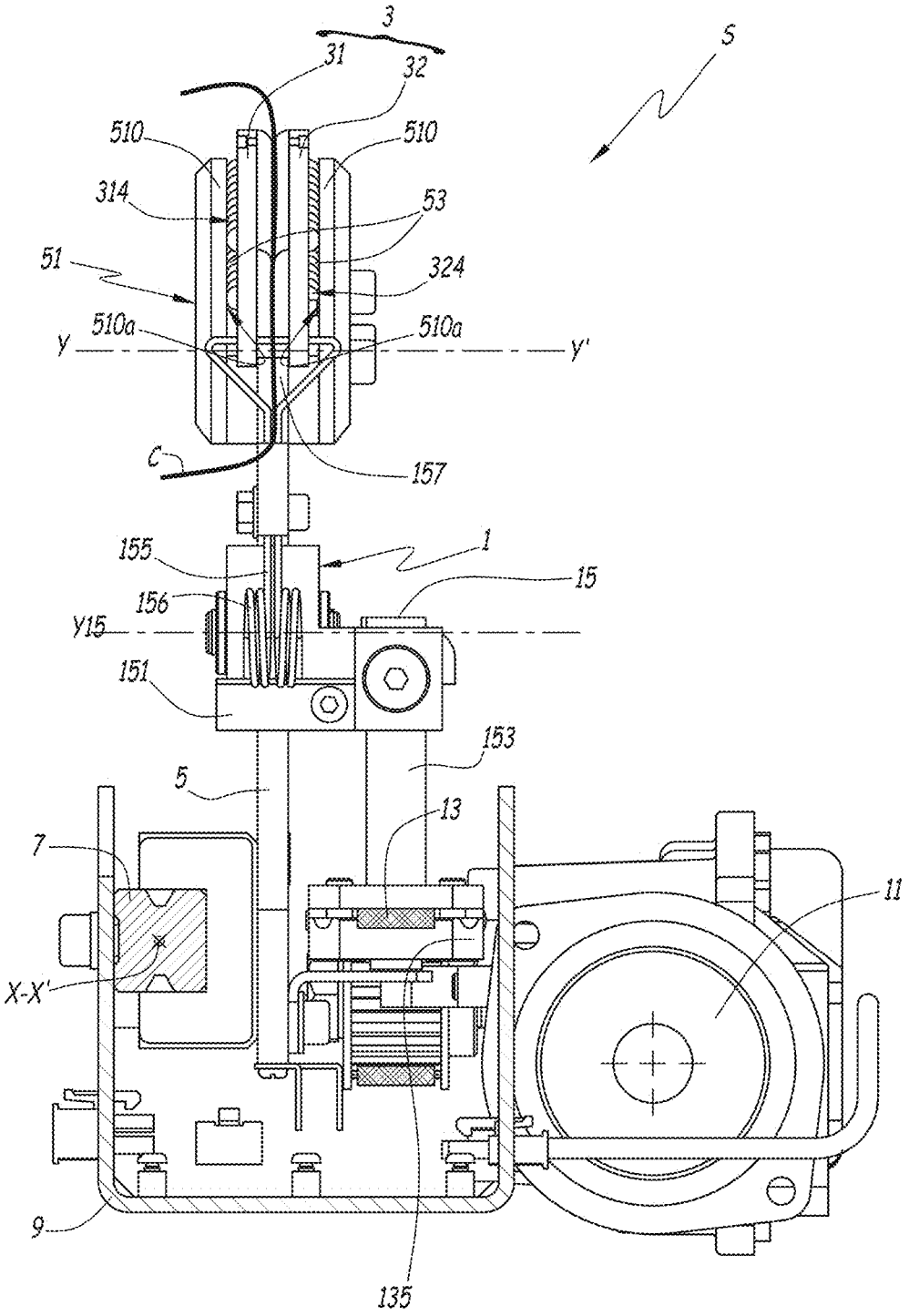
FIG. 6 is a view similar to FIG. 2, of the tensioning system in the configuration of FIG. 5.
Figure 7:
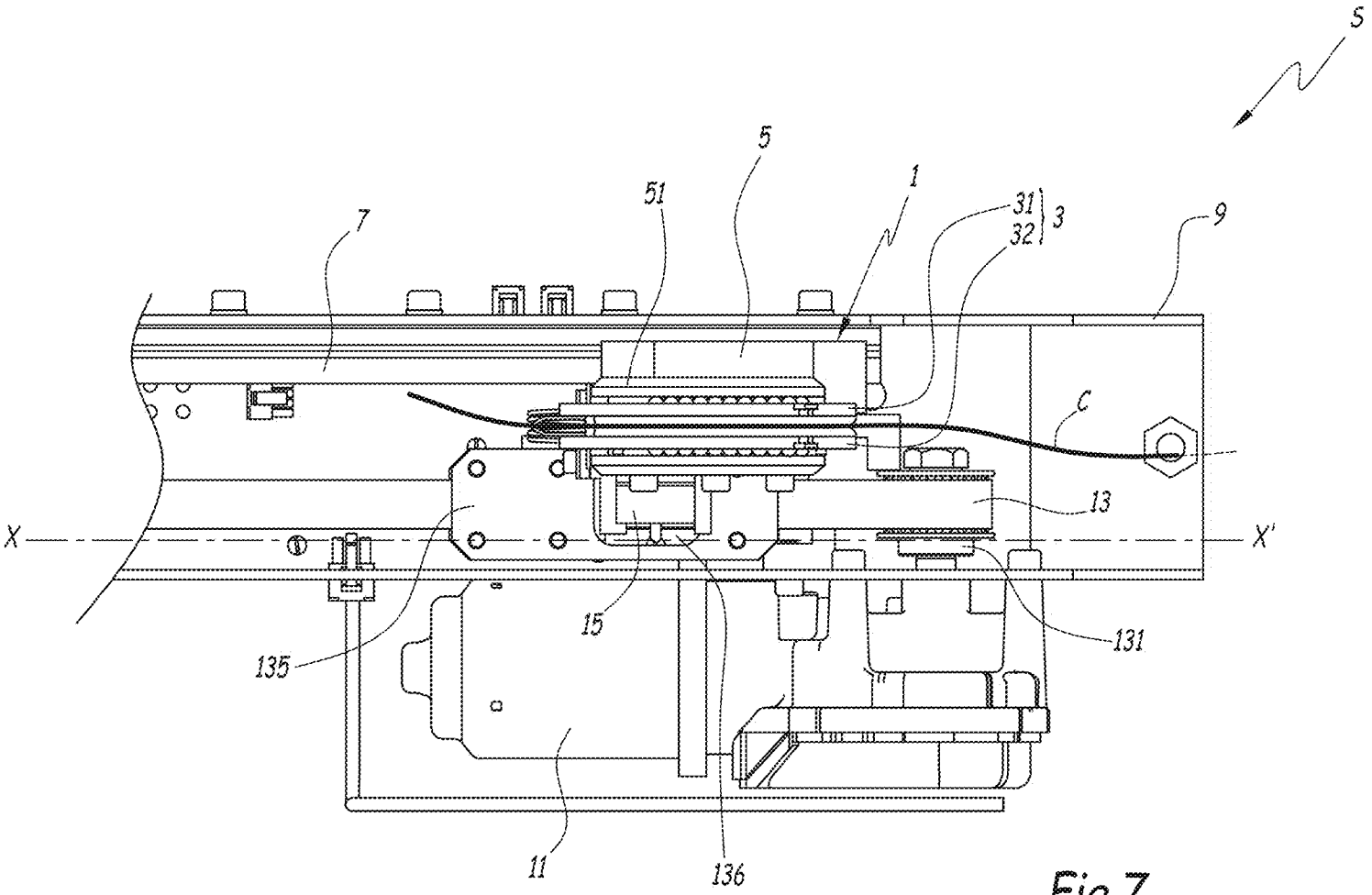
FIG. 7 is an enlarged view of detail VII in FIG. 3, of the tensioning system in the configuration of FIGS. 5 and 6.

FIGS. 5 to 8 show a gripping configuration of the grip 3, in which the jaws 31 and 32 are gripped against one another, as shown in FIGS. 4 and 6, the traction module 1 still being in the same position on the rail 7. In this configuration, the string C positioned between the jaws 31 and 32 is firmly kept in place in the grip 3 and ready to be stretched by applying the traction force T by translation along the axis X-X' of the traction module 1.

Figure 9:
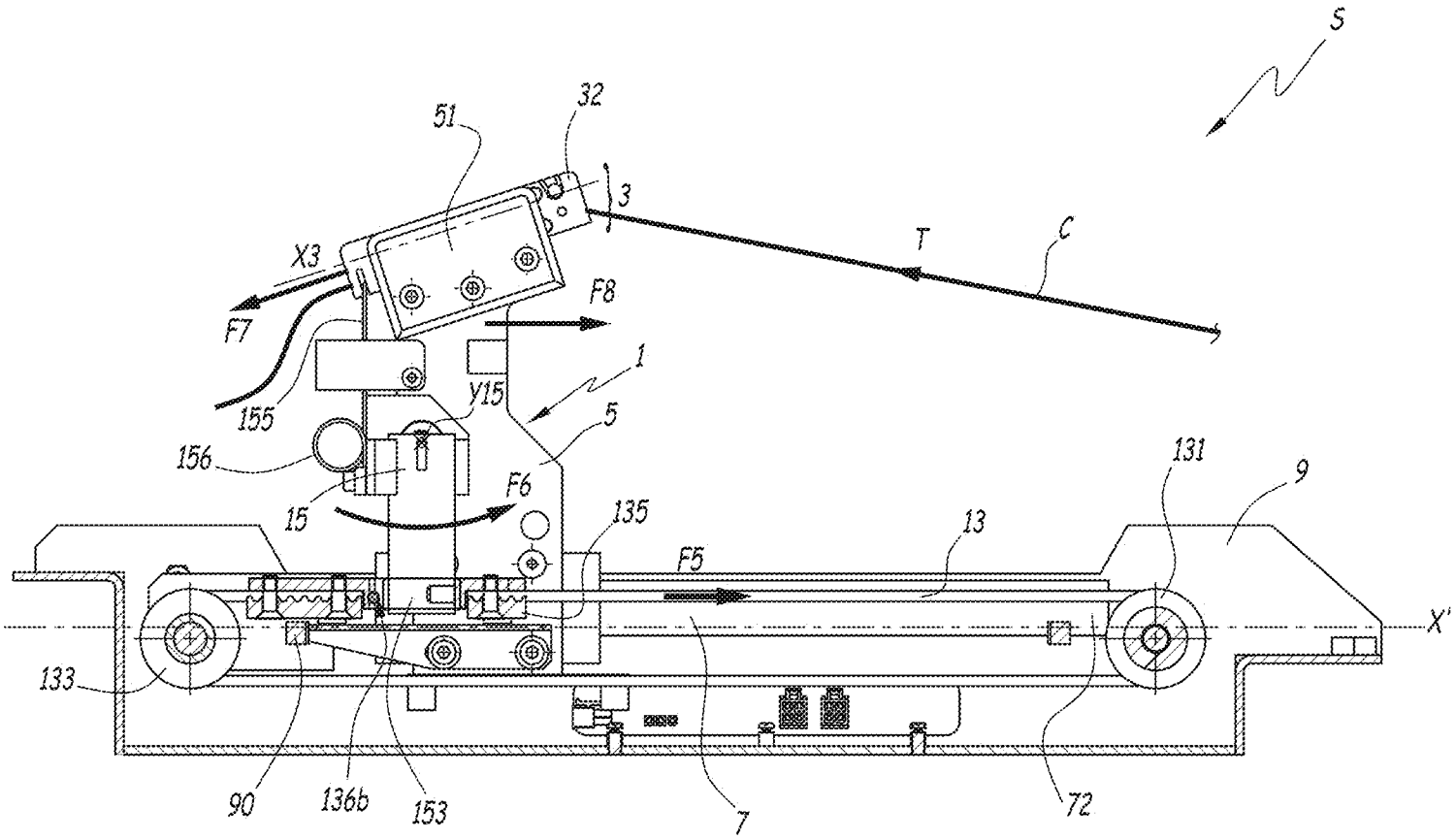
FIG. 9 is a cross-section similar to FIG. 1, of the tensioning system of FIGS. 1 to 3 and 5 to 7, in a third configuration.

FIG. 9 corresponds to an end-of-traction configuration of the system S, in which the string C is stretched, the traction module 1 being positioned at a second end 74 of the rail 7, opposite the first end 72 and situated on the left in FIGS. 1 and 9.

The jaws 31 and 32 are mobile relative to the traction head 5 along a longitudinal axis X3 that is inclined relative to the axis X-X'. The jaws 31 and 32 are mounted in a chute 51 of the traction head 5 and their translation is allowed by rows of beads 53, arranged in the chute 51 such that the translation along the axis X3 of the jaws 31 and 32 causes them to come closer together in a transverse direction Y-Y' and to be gripped around the string C.

To that end, the inner faces 510*a* of the longitudinal walls 510 of the chute 51 comprise longitudinal slots 512 in which the beads 53 are housed. The outer faces 314 and 324 of the jaws 31 and 32 comprise longitudinal slots 314*a* and 324*a* in which the beads 53 are housed, opposite the slots 512 of the walls 510.

The slots 512, 314*a* and 324*a* are beveled such that the alignment of the beads 53, which defines axes A53, forms an angle β relative to the axis X3. The slots 512, 314*a* and 324*a* converge toward the axis X3 toward the end 72, such that the translation of the jaws 31 and 32 along the axis X3 toward the end 72 along the arrows F3 in FIG. 4 causes gripping of the jaws 31 and 32 along arrows F3' in FIG. 8.

To initiate the translation along the axis X3 of the jaws 31 and 32 to keep the string C gripped in the grip 3, the tensioning system S comprises means for transmitting movement between the belt 13 and the jaws 31 and 32, those means being able to initiate the translation in the chute 51 of the jaws 31 and 32 relative to the traction head 5 in the gripping direction of the string C, and to transmit a translational movement to the traction head 5 relative to the rail 7 when the jaws 31 and 32 are gripped against one another.

Thus, the gripping of the jaws 31 and 32 is obtained using the traction motor 11, without requiring any particular manipulation of the string C by the operator. This allows a faster work pace and more uniform gripping of the strings in the grip 3, which reduces the risks of damage to the strings.

The movement transmitting means comprise a lever 15 mounted pivoting on the traction head 5 around an axis Y15 perpendicular to the axis X-X' and parallel to the direction Y-Y'. A part 151 of the lever 15 is mechanically connected to the jaws 31 and 32, while one end 153 of the lever 15, opposite the jaws 31 and 32, is connected to the belt 13 such that the translation of the belt 13 along the axis X-X' drives the rotation of the lever 15 relative to the traction head 5 around the axis Y15. The belt 13 is provided, to that end, with a plate 135 having an opening 136 in which the end 153 of the lever 15 is inserted.

The part 151 of the lever 15 is simultaneously connected to each of the jaws 31 and 32 by a rod 155 provided with an elastic element, such as a spiral spring 156, which makes it possible to reduce the resistance exerted by the jaws 31 and 32 against the rotation of the lever 15 around the axis Y15. In an alternative that is not shown, the rod 155 may comprise another type of elastic element.

The tensioning system S then operates according to the following principle: in the initial configuration of the system S, the string C is placed between the jaws 31 and 32. In order to grip the string C in the grip 3, the operator, for example using a button or pedal, activates the traction motor 11, which translates the belt 13 along the axis X-X', in the direction of arrow F1. Owing to the cooperation between the opening 136 and the end 153, the lever 15 is rotated around the axis Y15 in the direction of arrow F2. Since the part 151 of the lever 15 is connected to the jaws 31 and 32 by the rod 155 provided with the spring 156, the resistance to the translation of the traction module 1 provided by the jaws 31 and 32 is lower than the resistance to translation of the traction module 1 supplied by the frictional forces between the traction head 5 and the rail 7. The jaws 31 and 32 therefore undergo a translational movement along arrow F3 toward their gripped configuration shown in FIGS. 3 to 6.

The end of the rod 155 forms a rectilinear part 157 parallel to the direction Y-Y' that is inserted in slots, only one of which is visible with reference 320, of the jaws 31 and 32, such that the part 157 slides in the jaws 31 and 32 and the rotation of the rod 155 around the axis Y15 drives the translation of the jaws 31 and 32 along the axis X3.

When the jaws 31 and 32 are gripped, the resistance to rotation of the lever 15 relative to the traction head 5 increases and becomes greater than the resistance of the friction forces that exist between the rail 7 and the traction head 5. The rotation of the lever 15 is then locked by the resistance of the jaws 31 and 32 in a substantially vertical position relative to the axis X-X', shown in FIG. 5 and in which a surface 136*a* of the opening 136 is in planar bearing with a surface 153*a* of the end 153. The force exerted by the belt 13 on the lever 15 is therefore transmitted to the traction head 5 owing to that planar bearing, and the traction head 5 is then translated along the axis X-X' in the direction of arrow F4. This makes it possible to stretch the string C.

When the traction module 1 finishes its travel along the rail 7, against a stop 90 of the frame 9, near the end 74, the string C is stretched. The operator, in a known manner, locks the stretched string on the screen of the racket, using a clip holder, not shown, and can then release the string C from the grip 3 and initiate the return of the traction module 1 toward its initial position.

The release of the string C from the grip 3 is also done under the action of the motor 11. To that end, the operator commands the motor 11 in the opposite direction, such that the belt 13 is driven along the axis X-X' in the direction of arrow F5 in FIG. 9.

The end 153 comes into contact with an edge 136*b* of the opening 136 opposite the surface 136*a*, which results in rotating the lever 15 relative to the traction head 5, in the direction of arrow F6 toward its position of FIG. 1. This rotation of the lever 15 causes, via the rod 155, the translation of the jaws 31 and 32 along arrow F7, and the string C is thus loosened from the grip 3.

When the lever 15 has returned to its initial position, relative to the traction head 5, of FIG. 1, the translational movement of the belt 13 is transmitted to the traction head 5, which in turn undergoes a translational movement along arrow F8, causing the return of the traction module 1 to its initial position relative to the rail 7, of FIG. 1. Once it has returned to the right end 72 of the rail 7, the traction module 1 is ready to receive a new string C and repeat the tensioning operation.

The invention claimed is:

1. A system for tensioning a racket string, comprising:

a traction module suitable for exerting a traction force on a string of a racket, the traction module including a grip comprising two opposite jaws suitable for gripping the string between them when the string is tensioned, and a traction head on which the grip is mounted, the jaws being translatable simultaneously relative to the traction head and arranged such that the translation of the jaws causes them to tighten around the string, a rail on which the traction head of the traction module is translatably mounted, a traction motor able to translate the traction head of the traction module on the rail, via a driving system of the traction head, and means for transmitting movement between the driving system of the traction head and the jaws, the transmission means being able to initiate the translation of the jaws relative to the traction head in a direction gripping the string.

2. The system according to claim 1, wherein the transmission means comprise a lever mounted pivoting on the traction head, part of the lever being connected to the jaws, one of the lever opposite the jaws being connected to the driving system such that the translation of the driving system drives the rotation of the lever relative to the traction head around an axis perpendicular to the translation direction of the traction head.

3. The system according to claim 2, wherein the driving system comprises a belt or chain provided with a plate having an opening in which the end of the lever opposite the jaws is inserted.

4. The system according to claim 3, wherein the opening comprises a surface able to cooperate by planar bearing with a surface of the lever to drive the traction head in translation along the rail during tensioning of the string.

5. The system according to claim 2, wherein the rotation of the lever relative to the traction head is locked when the jaws are gripped around the string.

6. The system according to claim 3, wherein the part of the lever secured to the jaws is simultaneously connected to each of the jaws by a rod provided with an elastic element configured so that the gripping of the jaws takes place before the translation of the traction head on the rail.

7. The system according to claim 6, wherein the elastic element is a spiral spring.

8. The system according to claim 6, wherein the rod is mounted sliding in slots of the jaws such that the rotation of the rod drives the translation of the jaws.

9. The system according to claim 1, wherein once the string has been stretched, the grip is able to be loosened under the action of the traction motor.

10. A racket stringing machine, comprising a system for tensioning a string according to claim 1.

11. The system according to claim 1, further comprising a frame, wherein, the rail is mounted to the frame and the traction motor is fixed on the frame, the traction head is translatably mounted on the rail along a traction axis(X-X'), the driving system of the traction head includes a belt stretched between a drive pulley, driven by the traction motor, and a pulley at an opposite end of the frame relative to the drive pulley, the belt including a plate having an opening, the means for transmitting movement includes a lever, a part of the lever being mechanically connected to the two jaws, and one end of the lever, opposite the two jaws, being inserted in the opening of the plate with a surface of the opening in planar bearing with a surface of one the end of the lever, the lever being mounted pivoting on the traction head around an axis (Y15) perpendicular to the traction axis (X-X'), with the one end of the lever, opposite the two jaws, being connected to the belt such that the translation of the belt along the traction axis (X-X') drives the rotation of the lever relative to the traction head around the axis (Y15) perpendicular to the traction axis (X-X').

12. The system according to claim 11, further comprising a frame, wherein, with the string placed between the two jaws, activation of the traction motor translates the belt along the traction axis (X-X'), and due to cooperation between the opening of the plate and the one end of the lever, the lever is rotated in a first direction (F2) around the axis (Y15) perpendicular to the traction axis (X-X') and the part of the lever mechanically connected to the two jaws undergo a translational movement along a second direction (F3) opposite the first direction (F2) toward a gripped configuration that grips the strings in the two jaws.

* * * * *